US009598750B2

(12) United States Patent
Kim et al.

(10) Patent No.: US 9,598,750 B2
(45) Date of Patent: Mar. 21, 2017

(54) HIGH CR FERRITIC/MARTENSITIC STEELS HAVING AN IMPROVED CREEP RESISTANCE FOR IN-CORE COMPONENT MATERIALS IN NUCLEAR REACTOR, AND PREPARATION METHOD THEREOF

(75) Inventors: Sung Ho Kim, Daejeon (KR); Jong Hyuk Baek, Daejeon (KR); Tae Kyu Kim, Daejeon (KR); Woo Gon Kim, Daejeon (KR); Jun Hwan Kim, Daejeon (KR); Chang Hee Han, Daejeon (KR); Chan Bock Lee, Daejeon (KR); Yeong-Il Kim, Daejeon (KR); Dohee Hahn, Daejeon (KR)

(73) Assignees: KOREA ATOMIC ENERGY RESEARCH INSTITUTE, Daejeon (KR); KOREA HYDRO AND NUCLEAR POWER CO., LTD, Seoul (KR)

( * ) Notice: Subject to any disclaimer, the term of this patent is extended or adjusted under 35 U.S.C. 154(b) by 1213 days.

(21) Appl. No.: 13/280,585

(22) Filed: Oct. 25, 2011

(65) Prior Publication Data

US 2012/0106693 A1 May 3, 2012

(30) Foreign Application Priority Data

Oct. 26, 2010 (KR) ..... 10-2010-0104658
Aug. 9, 2011 (KR) ..... 10-2011-0079032

(51) Int. Cl.
*C22C 38/02* (2006.01)
*C22C 38/00* (2006.01)
(Continued)

(52) U.S. Cl.
CPC ..... *C22C 38/001* (2013.01); *C21D 6/002* (2013.01); *C22C 1/02* (2013.01); *C22C 38/02* (2013.01);
(Continued)

(58) Field of Classification Search
CPC ..... C22C 38/02
(Continued)

(56) References Cited

U.S. PATENT DOCUMENTS

2005/0098240 A1 5/2005 Ishikawa et al.
2006/0060270 A1 * 3/2006 Klueh et al. ..... 148/609

FOREIGN PATENT DOCUMENTS

EP 0887431 A1 12/1998
EP 1227168 B1 5/2005
JP 2000-80448 A 3/2000

* cited by examiner

*Primary Examiner* — Brian Walck
(74) *Attorney, Agent, or Firm* — Maier & Maier, PLLC

(57) ABSTRACT

Disclosed herein is a high Cr Ferritic/Martensitic steel comprising 0.04 to 0.13% by weight of carbon, 0.03 to 0.07% by weight of silicon, 0.40 to 0.50% by weight of manganese, 0.40 to 0.50% by weight of nickel, 8.5 to 9.5% by weight of chromium, 0.45 to 0.55% by weight of molybdenum, 0.10 to 0.25% by weight of vanadium, 0.02 to 0.10% by weight of tantalum, 0.21 to 0.25% by weight of niobium, 1.5 to 3.0% by weight of tungsten, 0.015 to 0.025% by weight of nitrogen, 0.01 to 0.02% by weight of boron and iron balance. By regulating the contents of alloying elements such as nitrogen, born, the high Cr Ferritic/Martensitic steel with superior tensile strength and creep resistance is provided, and can be effectively used as an in-core component material for sodium-cooled fast reactor (SFR).

10 Claims, 4 Drawing Sheets

(51) Int. Cl.

| | |
|---|---|
| ***C21D 6/00*** | (2006.01) |
| ***C22C 1/02*** | (2006.01) |
| ***C22C 38/04*** | (2006.01) |
| ***C22C 38/44*** | (2006.01) |
| ***C22C 38/46*** | (2006.01) |
| ***C22C 38/48*** | (2006.01) |
| ***C22C 38/54*** | (2006.01) |
| *G21C 1/02* | (2006.01) |
| *G21C 3/07* | (2006.01) |

(52) U.S. Cl.
CPC ..... *C22C 38/04* (2013.01); *C22C 38/44* (2013.01); *C22C 38/46* (2013.01); *C22C 38/48* (2013.01); *C22C 38/54* (2013.01); *C21D 2211/005* (2013.01); *C21D 2211/008* (2013.01); *G21C 1/02* (2013.01); *G21C 3/07* (2013.01)

(58) Field of Classification Search
USPC ..... 148/325, 330, 333–336, 605–610
See application file for complete search history.

HIGH CR FERRITIC/MARTENSITIC STEELS HAVING AN IMPROVED CREEP RESISTANCE FOR IN-CORE COMPONENT MATERIALS IN NUCLEAR REACTOR, AND PREPARATION METHOD THEREOF

RELATED APPLICATIONS

This application claims priority under 35 U.S.C. §119 to Korean Patent Application No(s): KR 10-2010-0104658 filed Oct. 26, 2010 and KR 10-2011-0079032 filed Aug. 9, 2011, the disclosures of which are incorporated by reference herein their entireties.

BACKGROUND OF THE INVENTION

1. Field of the Invention

The present invention relates to high Cr Ferritic/Martensitic steels having improved creep resistance for in-core component materials in a nuclear reactor and a preparation method thereof.

2. Description of the Related Art

The sodium-cooled fast reactor (SFR) uses a fast neutron, and has nuclear fuel breeding characteristic. Accordingly, since the early stage of nuclear power industry, SFR has been continuously developed mainly for efficient use of uranium resources. Recently, as reflected in the Generation IV reactor (Gen IV) development program, the sodium-cooled fast reactor has regained the spotlight for recycling of used nuclear fuels and transmutation of long-lived radionuclide wastes.

Nuclear fuel is an essential element of sodium-cooled fast reactor in which processing such as nuclear fission for energy generation, fuel breeding from nuclear material or transmutation of nuclear waste is performed. Therefore, the stability of nuclear fuel in which radioactive nuclear fission products are contained is directly related to the stability of nuclear reactor.

Since a nuclear fuel cladding tube seals fuel slug and prevents radioactive materials from leaking, the nuclear fuel cladding tube is the most important nuclear fuel component which is directly related to the safety of nuclear fuel and a nuclear reactor. The nuclear fuel cladding tube of SFR is designed to use in severe conditions of high temperature and high neutron irradiation. Therefore, a cladding tube having excellent creep resistance at high temperature and a constant ductility while having a low swelling until high neutron irradiation should be developed. In order to realize this, the development of a new material having high temperature/irradiation resistance under conditions of coolant at high temperature and high neutron irradiation, and good compatibility with liquid sodium.

Thus, high Cr Ferritic/Martensitic Steel (FMS) which has superior properties at a high temperature has drawn wide attention as a candidate material for major core components in Generation IV reactor and nuclear fusion reactor.

The FM steel including 8 to 12% by weight of chromium has been used as a material for the in-core components of the fast breeder reactor which uses fast neutrons, including a nuclear fuel cladding tube, a duct which wraps the nuclear fuel cladding tube, since the 1970 because FMS has the superior thermal properties and irradiation swelling resistance, compared to austenitic stainless steels (e.g., SS316, SS304).

The high Cr FM steel may be largely classified into 9Cr-1Mo (ASME T9) series and 12Cr (AISI 410) series, and the course in which the high Cr FM steel has been modified is shown in FIG. 1. As shown in FIG. 1, as the 9Cr-1Mo series, 9Cr-2Mo (HCM 9), 9Cr-2MoVNb (EM12), and 9Cr-1MoVNb (Tempaloy F-9) having a creep rupture strength of about 60 MPa at 600° C. for $10^5$ hours were developed, and later 9Cr—MoVNb (ASME T91) having a creep rupture strength of about 100 MPa was developed. In addition, Sumitomo Corp. of Japan developed 9Cr-0.5Mo-1.8 WVNb (ASME T92) having a creep rupture strength of about 130 MPa by reducing Mo element from ASME T91 and adding W, and NF12 (11Cr—WCo—NiVNb) alloy having a creep rupture strength of about 150 MPa was also developed.

12Cr-1Mo—VW (HT9), 12Cr-1Mo-1WVNb (HCM12), and 11Cr-0.4Mo-2WVNbCu (ASME T122) were developed as the 12Cr series, and 11Cr—WCo—VNb (SAVE12) steel having a creep rupture strength of about 150 MPa was developed.

As shown in FIG. 1, it was determined that in the development process of high Cr Ferritic/Martensitic Steel (FMS), a steel to which Co was added as an alloy element had an excellent creep rupture strength, and a high Cr Ferritic/Martensitic Steel (FMS), to which Co was added to have an excellent heat resistance and creep rupture strength, was disclosed in EP 0806490B1.

However, as disclosed in EP 0806490B1, when a Ferritic/Martensitic Steel (FMS), to which Co components are added, is used, a safety issue for workers working in sealed nuclear power plants emerges, and thus the steel is not appropriate for nuclear energy, in particular, as a material related to nuclear reactors.

In the mid 1980s, material development program of nuclear fusion reactor has begun to develop in earnest, and the concept of reduced-activation steel was introduced. In such a circumstance, studies of low radioactive FM steel (RAFMS) were actively conducted, starting with the material such as FM steel of ASTM GR.91 alloy (main components: 9% Cr-1% Mo-0.20% V-0.08% Nb), which is well known as modified 9Cr-1 Mo steel. The low radioactive FM steel has limitations in terms of the alloy elements added to reduce long-lived high level radioactive material generated by fast neutron irradiation. That is, the addition of molybdenum, niobium, nickel, copper, and nitrogen to low radioactive FM steel was strictly limited. Instead, adding tungsten and tantalum to low radioactive FM steel was suggested. Also, an alloy with 7 to 9% reduced chromium is preferred as a way of inhibiting the generation of δ-ferrite phase which has bad influence on impact properties without increasing addition of carbon or manganese which is an α-phase stabilizing element. With these series of studies, F82H alloy (main components: 8% Cr-2.0% W-0.25% V-0.04% Ta) and JLF-1 alloy (main components: 9% Cr-2.0% W-0.25% V-0.05% Ta-0.02% Ti) from Japan, EUROFER-97 alloy (main components: 9% Cr-1.1% W-0.20% V-0.12% Ta-0.01% Ti) from Europe, and ORNL 9Cr-2WVTa (main components: 9% Cr-2.0% W-0.25% V-0.07% Ta) from US have been developed.

However, since a SFR nuclear cladding tube is used under severe conditions such as high temperature and irradiation of fast neutrons, it is still necessary to develop a high Cr Ferritic/Martensitic steel having improved creep resistance.

Thus, the present inventors have studied to develop high Cr Ferritic/Martensitic steels having improved creep resistance at high temperatures, and developed a high Cr Ferritic/Martensitic steel exhibiting excellent creep resistance by optimizing the composition of alloying elements of niobium, tantalum, tungsten, nitrogen, boron, carbon, and the like, thereby completing the present invention.

SUMMARY OF THE INVENTION

One object of the present invention is to provide high Cr Ferritic/Martensitic steels having improved creep resistance as a nuclear fuel material for sodium-cooled fast reactor (SFR) and a preparation method thereof.

In order to achieve the object, the present invention provides a high Cr Ferritic/Martensitic steel including 0.04 to 0.13% by weight of carbon, 0.03 to 0.07% by weight of silicon, 0.40 to 0.50% by weight of manganese, 0.40 to 0.50% by weight of nickel, 8.5 to 9.5% by weight of chromium, 0.45 to 0.55% by weight of molybdenum, 0.10 to 0.25% by weight of vanadium, 0.02 to 0.10% by weight of tantalum, 0.21 to 0.25% by weight of niobium, 1.5 to 3.0% by weight of tungsten, 0.015 to 0.025% by weight of nitrogen, 0.01 to 0.02% by weight of boron and iron balance.

The high Cr Ferritic/Martensitic steel is characterized by not including cobalt.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
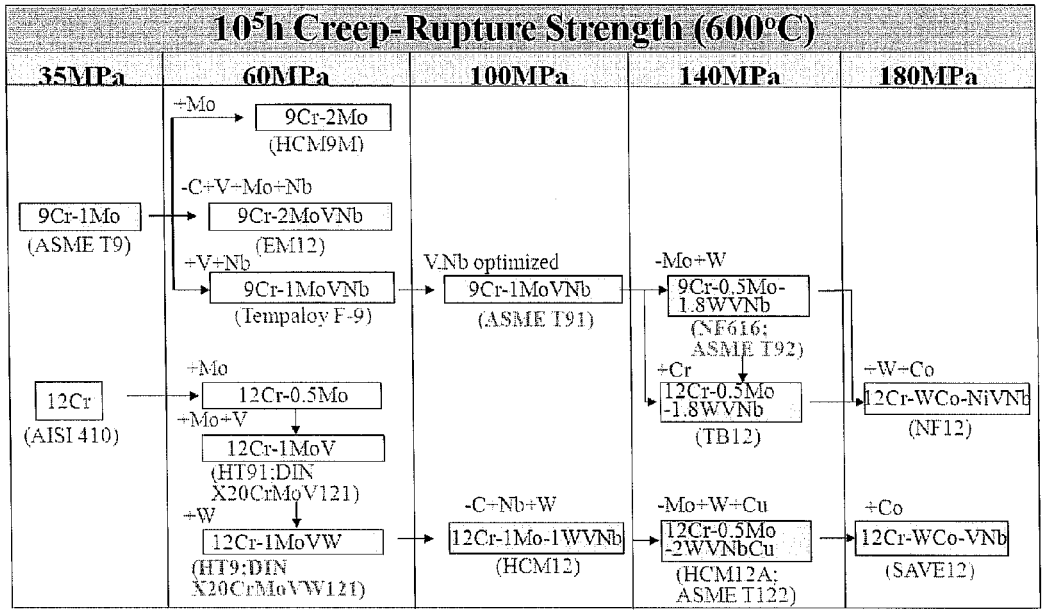
FIG. 1 is a schematic view illustrating the development course of high Cr Ferritic/Martensitic steels.

Features and advantages of the present invention will be more clearly understood by the following detailed description of the present preferred embodiments by reference to the accompanying drawings. It is first noted that terms or words used herein should be construed as meanings or concepts corresponding with the technical sprit of the present invention, based on the principle that the inventor can appropriately define the concepts of the terms to best describe his own invention. Also, it should be understood that detailed descriptions of well-known functions and structures related to the present invention will be omitted so as not to unnecessarily obscure the important point of the present invention.

Hereinafter, the present invention will be described in detail.

The present invention provides a high Cr Ferritic/Martensitic steel including 0.04 to 0.13% by weight of carbon, 0.03 to 0.07% by weight of silicon, 0.40 to 0.50% by weight of manganese, 0.40 to 0.50% by weight of nickel, 8.5 to 9.5% by weight of chromium, 0.45 to 0.55% by weight of molybdenum, 0.10 to 0.25% by weight of vanadium, 0.02 to 0.10% by weight of tantalum, 0.21 to 0.25% by weight of niobium, 1.5 to 3.0% by weight of tungsten, 0.015 to 0.025% by weight of nitrogen, 0.01 to 0.02% by weight of boron and iron balance.

In addition, the present invention provides a high Cr Ferritic/Martensitic steel including 0.04 to 0.13% by weight of carbon, 0.03 to 0.07% by weight of silicon, 0.40 to 0.50% by weight of manganese, 0.40 to 0.50% by weight of nickel, 8.5 to 9.5% by weight of chromium, 0.45 to 0.55% by weight of molybdenum, 0.10 to 0.25% by weight of vanadium, 0.02 to 0.10% by weight of tantalum, 0.21 to 0.25% by weight of niobium, 1.5 to 3.0% by weight of tungsten, 0.015 to 0.025% by weight of nitrogen, 0.01 to 0.02% by weight of boron and iron balance, wherein the high Cr Ferritic/Martensitic steel may not include cobalt.

Furthermore, the present invention provides a high Cr Ferritic/Martensitic steel including 0.04 to 0.13% by weight of carbon, 0.03 to 0.07% by weight of silicon, 0.40 to 0.50% by weight of manganese, 0.40 to 0.50% by weight of nickel, 8.5 to 9.5% by weight of chromium, 0.45 to 0.55% by weight of molybdenum, 0.10 to 0.25% by weight of vanadium, 0.02 to 0.10% by weight of tantalum, 0.21 to 0.25% by weight of niobium, 1.5 to 3.0% by weight of tungsten, 0.015 to 0.025% by weight of nitrogen, 0.01 to 0.02% by weight of boron and iron balance as essential components. The term "essential" means that impurities to be inevitably included in the preparation process may be included besides the components.

The followings are the functions and effects of respective elements added to the high Cr Ferritic/Martensitic steel according to the present invention.

(1) Carbon (C)

In a high Cr Ferritic/Martensitic steel according to the present invention, carbon forms carbide to provide precipitation hardening effect. Preferably, carbon is contained in an amount of 0.04 to 0.13% by weight. If the amount of the carbon is less than 0.04% by weight, the mechanical strength deteriorates at a room temperature and toughness also deteriorates. In particular, delta ferrite is produced due to an increase in Cr equivalent. If the amount of carbon is more than 0.13% by weight, many carbides are produced, and strengthening effect of precipitates degrades since such carbides are easily coarsened during use.

(2) Silicon (Si)

In a high Cr Ferritic/Martensitic steel according to the present invention, silicon improves oxidation resistance, and is used as a deoxidant in steel manufacturing. Silicon is contained preferably in an amount of 0.03 to 0.07% by weight. If the amount of silicon is less than 0.03% by weight, corrosion resistance deteriorates, and if the amount of silicon is more than 0.07% by weight, the generation of laves phase is promoted, thereby degrading toughness.

(3) Manganese (Mn)

In a high Cr Ferritic/Martensitic steel according to the present invention, manganese promotes hardenability. Preferably, manganese is contained in an amount of 0.40 to 0.50% by weight. If the amount of manganese is less than 0.40% by weight, there is a problem associated with hardenability, and if the amount of manganese is more than 0.50% by weight, creep resistance deteriorates.

(4) Nickel (Ni)

In a high Cr Ferritic/Martensitic steel according to the present invention, nickel suppresses the production of delta ferrite by increasing the chromium (Cr) equivalent. Preferably, nickel is contained in an amount of 0.40 to 0.50% by weight. If the amount of nickel is less than 0.40% by weight, delta ferrite which is weak in toughness is produced, and if the amount of nickel is more than 0.50% by weight, as in the case of manganese, creep resistance degrades.

(5) Chromium (Cr)

In a high Cr Ferritic/Martensitic steel according to the present invention, chromium is known to enhance corrosion resistance and high-temperature strength. Preferably, chromium is contained in an amount of 8.5 to 9.5% by weight. If the amount of chromium is less than 8.5% by weight, resistance against high temperature oxidation and corrosion degrades, and if the amount of chromium is more than 9.5% by weight, creep resistance degrades.

(6) Molybdenum (Mo)

In a high Cr Ferritic/Martensitic steel according to the present invention, molybdenum has solid-solution hardening effect. Preferably, molybdenum is contained in an amount of 0.45 to 0.55% by weight. Since the molybdenum content is co-related with the tungsten content, the chromium equivalent decreases and delta ferrite is generated if the amount of molybdenum in a steel containing tungsten is less than 0.45% by weight, and if the amount of molybdenum is more than 0.55% by weight, laves phase which has brittleness is produced massively.

(7) Vanadium (V)

In a high Cr Ferritic/Martensitic steel according to the present invention, vanadium is an alloy element exhibiting precipitate hardening. Preferably, vanadium is contained in an amount of 0.1 to 0.25% by weight. If the amount of the vanadium is less than 0.1% by weight, creep resistance deteriorates since the sites where precipitates are produced decrease, which is causing irregular distribution of carbides, and form coarse carbides. If the amount of vanadium is more than 0.25% by weight, all the solid solution carbon and nitrogen in a matrix are consumed, and other forms of carbides are hardly produced during use.

(8) Niobium (Nb)

In a high Cr Ferritic/Martensitic steel according to the present invention, niobium is an alloy element exhibiting precipitate hardening. Preferably, niobium is contained in an amount of 0.21 to 0.25% by weight. If the amount of niobium is less than 0.21% by weight, niobium precipitates are not sufficiently produced, causing austenitic grain growth during normalizing treatment, thereby deteriorating the mechanical performance. If the amount of niobium is more than 0.25% by weight, the non-solid solution niobium content increases, decreasing the vanadium precipitates which are effective for creep resistance, and consuming solid solution carbons in a matrix, thereby reducing the carbide precipitates such as M23C6 and eventually decreasing the long-term creep resistance.

(9) Tantalum (Ta)

In a high Cr Ferritic/Martensitic steel according to the present invention, tantalum is a low radioactive element and has precipitation hardening effect when contained in niobium precipitates. To achieve the superior mechanical properties in the present invention, tantalum is contained preferably in amount of 0.02 to 0.10% by weight. If the amount of tantalum is more than 0.10% by weight, the same problem is experienced as in the case of adding an excessive amount of niobium.

(10) Tungsten (W)

In a high Cr Ferritic/Martensitic steel according to the present invention, tungsten is representative solid-solution hardening alloy element. Preferably, tungsten is contained in an amount of 1.5 to 3.0% by weight. If the amount of tungsten is less than 1.5% by weight, effective solid-solution hardening can not be obtained, and if the amount of tungsten is more than 3.0% by weight, laves phase, which is known to degenerate long-term creep resistance and toughness, is produced.

(11) Nitrogen (N)

In a high Cr Ferritic/Martensitic steel according to the present invention, nitrogen forms nitride or solidifies interstitial form to increase the strength. However, added nitrogen forms boron carbides in a steel to which a predetermined amount of boron is added, and the creep resistance is deteriorated. Thus, nitrogen is preferably contained in an amount of 0.015 to 0.025% by weight in a boron-added steel. If the amount of the nitrogen is less than 0.015% by weight, corrosion resistance degrades, and if the amount of nitrogen is more than 0.025% by weight, boron carbides form and creep resistance degrades rapidly.

(12) Boron (B)

In a high Cr Ferritic/Martensitic steel according to the present invention, boron segregates along boundaries and reinforces boundaries to enhance creep resistance at a high temperature. Preferably, boron is contained in an amount of 0.01 to 0.02% by weight. If the amount of boron is less than 0.01% by weight, effective boundary enforcement cannot be achieved, and if the amount of boron is more than 0.02% by weight, boron precipitates cause problems in production.

Although a high Cr Ferritic/Martensitic steel according to the present invention is known to enhance high temperature resistance and creep rupture strength of the Ferritic/Martensitic steel, the steel does not include cobalt (Co) having high radioactive energy, which is very problematic, and exhibits superior tensile strength and creep resistance compared to conventional high Cr Ferritic/Martensitic steels which have been used as materials for nuclear reactor components. Thus, the steel according to the present invention may be used as a material for nuclear power plants, in particular, as a component of nuclear reactor (for example, in-core component in nuclear reactors, etc.). Furthermore, the high Cr Ferritic/Martensitic steel according to the present invention may be useful as a component in a Generation IV sodium-cooled fast reactor (SFR) which is used under severe conditions of high temperature and high amount of neutrons, for example, as an in-core component in Generation IV SFR.

The in-core is an expression which indicates a central unit of a nuclear reactor, and means a portion in which nuclear fission reactions occur, the in-core component in which the high Cr Ferritic/Martensitic steel according to the present invention may be used includes a nuclear fuel cladding tube, a duct, a wire wrap, and the like, and the in-core components formed of the high Cr Ferritic/Martensitic steel according to the present invention may be used to fabricate a nuclear fuel assembly such that the fuel allows nuclear fission reactions to occur safely under severe conditions of high temperature and high irradiation of neutrons, may prevent radioactive materials from leaking outside, and may be used under an environment of high temperature and high irradiation of neutrons for a long period due to their superior compatibility with liquid sodium and mechanical properties.

A high Cr Ferritic/Martensitic steel according to the present invention may be achieved by any of the methods conventionally known in the art which may include: mixing and dissolving alloy elements to prepare an ingot (step 1): hot rolling the ingot prepared in step 1 (step 2): normalizing and air cooling the ingot hot rolled in step 2 (step 3): and tempering and then air cooling the alloy normalized in step 3 to prepare a high Cr Ferritic/Martensitic steel (step 4).

To produce the high Cr Ferritic/Martensitic steel according to the present invention into required forms for nuclear fuel components (such as a nuclear fuel cladding tube or duct of a sodium-cooled fast reactor), after the tempering in step 3 above, steps of heat treatment and cold working may additionally be performed several times and then final heat treatment step may be further performed.

Hereinafter, respective steps of a preparation method of the present invention will be described in detail.

First, in step 1, an ingot is prepared by mixing and melting alloy elements.

The alloy elements may use carbon, silicon, manganese, nickel, chromium, vanadium, tantalum, niobium, tungsten, nitrogen, boron, and iron balance, and specifically, include 0.04 to 0.13% by weight of carbon, 0.03 to 0.07% by weight of silicon, 0.40 to 0.50% by weight of manganese, 0.40 to 0.50% by weight of nickel, 8.5 to 9.5% by weight of chromium, 0.45 to 0.55% by weight of molybdenum, 0.10 to 0.25% by weight of vanadium, 0.02 to 0.10% by weight of tantalum, 021 to 0.25% by weight of niobium, 1.5 to 3.0% by weight of tungsten, 0.015 to 0.025% by weight of nitrogen, 0.01 to 0.02% by weight of boron and iron balance.

The ingot may be prepared by vacuum indction melting (VIM) method.

Specifically, in a melting chamber, alloy elements may be melted under the atmosphere of high vacuum ($1\times10^{-5}$ to 0.5 torr) with induced currents applied, and deoxidant such as aluminum or silicon is introduced. At a point when melting almost finishes, micro-elements, particularly nitrogen, and the like may be charged into the melting chamber and a sample for chemistry analysis is collected. After the melting is completed, the molten metal is poured into a rectangular mold at 1500° C. to early out an outflow, and an oxidized layer of the surface is mechanically processed to prepare the ingot.

Next, in step 2, the ingot prepared in step 1 is hot rolled.

Through the hot rolling, a hot worked product which is suitable for hot working is prepared. The hot rolling is preferably performed at 1100 to 1200° C. for 0.5 to 2 hours. In case the above-mentioned conditions are not satisfied, for example, if the temperature is less than 1100° C., the purpose of solution annealing is not satisfactorily achieved, and if the temperature is more than 1200° C., the grain size of prior-γ phase may grow too excessively to degrade the mechanical properties of the final product.

Next, in step 3, the product hot worked in step 2 is normalized and air-cooled.

The normalizing is preferably performed at the γ-phase temperature of 1000 to 1100° C. for 0.5 to 2 hours to re-dissolve the precipitate phase which is unnecessarily produced on the hot worked product, and to regulate the cooling temperature to thus control the size and amount of the precipitates.

Next, in step 4, the alloy normalized in step 3 is tempered and air-cooled to prepare a high Cr Ferritic/Martensitic steel.

The tempering is preferably performed at 600 to 800° C. for 1 to 3 hours to produce stable, fine and uniform precipitates.

With the preparation method explained above, a high Cr Ferritic/Martensitic steel according to the present invention may be prepared.

Furthermore, to prepare a high Cr Ferritic/Martensitic steel according to the present invention as a component for SFR nuclear fuel, after the heat treatment of step 3 above, steps of heat treating and cold working may be additionally performed several times and then step of final heat treatment may be further performed.

Specifically, the additional heat treating may be performed at 600 to 800° C. for 1 to 3 hours, cold working may be performed 2 to 4 times, and final heat treating may be performed at 600 to 800° C. for 1 to 3 hours to prepare a high Cr Ferritic/Martensitic steel.

A high Cr Ferritic/Martensitic steel prepared according to the preparation method explained above have superior tensile strength at a high temperature of 650° C., and also superior creep resistance. Since the high Cr Ferritic/Martensitic steel exhibits superior mechanical properties compared to the conventional high Cr Ferritic/Martensitic steels, the high Cr Ferritic/Martensitic steel according to the present invention may be useful as a material for nuclear fuel cladding tube, duct and wire wrap, which are main in-core components in a Generation IV sodium-cooled fast reactor which is used under severe conditions of high temperature and high amount of neutrons.

If boron to be added to the high Cr Ferritic/Martensitic steel of the present invention is added as a boundary enforcement element in an appropriate amount, the element may be present in a solid solution state in a matrix and inhibit the movement of the grain boundary, thereby enhancing the creep resistance of the high Cr Ferritic/Martensitic steel. However, if nitrogen is added in a predetermined amount or more along with boron, boron is bound to nitrogen to easily form boron nitrides. These precipitates may decrease boundary enforcement effects by boron significantly, and boron nitrides precipitated do not exhibit precipitation enforcement effects, thereby deteriorating the creep resistance of the high Cr Ferritic/Martensitic steel. Therefore, in order to enhance the creep resistance by addition of boron, it is necessary not only to add boron in a predetermined amount or more, but also to limit the amount of nitrogen to a predetermined amount or less.

Hereinafter, the present invention will be described in more detail with reference to Examples.

However, the following Examples are provided for illustrative purposes only, and the scope of the present invention should not be limited thereto in any manner.

Example 1

Preparation of High Cr Ferritic/Martensitic Steels

As for experimental materials, 0.065% by weight of carbon, 0.043% by weight of silicon, 0.45% by weight of manganese, 0.44% by weight of nickel, 9.04% by weight of chromium, 0.5% by weight of molybdenum, 0.2% by weight of vanadium, 0.05% by weight of tantalum, 0.21% by weight of niobium, 1.99% by weight of tungsten, 0.02% by weight of nitrogen, 0.015% by weight of boron, and iron balance were processed in a vacuum induction melting furnace into a 30 kg of ingot. The ingot was maintained at 1150° C. for 2 hours, and subjected to hot rolling to obtain a final thickness of 15 mm.

Heat treatment was then performed as follows.

Specifically, the alloy was normalized at 1050° C. for 1 hour, and was air-cooled.

After that, the normalized alloy was tempered at 750° C. for 2 hours and was air-cooled to form a high Cr Ferritic/Martensitic steel.

The high Cr Ferritic/Martensitic steel was subjected to additional heat treatment and cool working which were repeated successively at 600 to 800° C. for 1 to 3 hours 2 to 4 times, and then subjected to final heat treatment at 600 to 800° C. for 1 to 3 hours to prepare a final product of high Cr Ferritic/Martensitic steel.

Example 2

A high Cr Ferritic/Martensitic steel was prepared in the same manner as in the method of Example 1, except that 0.069% by weight of carbon, 0.042% by weight of silicon, 0.452% by weight of manganese, 0.450% by weight of nickel, 9.1% by weight of chromium, 0.51% by weight of molybdenum, 0.107% by weight of vanadium, 0.05% by weight of tantalum, 0.21% by weight of niobium, 2.0% by weight of tungsten, 0.02% by weight of nitrogen, 0.015% by weight of boron, and iron balance were used as experimental materials.

Comparative Example 1

Conventional available ASTM Gr.92 alloy was used.

(Composition: 0.096% by weight of carbon, 0.060% by weight of silicon, 0.44% by weight of manganese, 0.19% by weight of nickel, 8.95% by weight of chromium, 0.48% by weight of molybdenum, 0.204% by weight of vanadium, 0.055% by weight of niobium, 1.9% by weight of tungsten, 0.045% by weight of nitrogen, and iron balance)

Comparative Example 2

Conventional available HT9 alloy was used.

(Composition: 0.192% by weight of carbon, 0.14% by weight of silicon, 0.490% by weight of manganese, 0.484% by weight of nickel, 12.05% by weight of chromium, 1.00% by weight of molybdenum, 0.304% by weight of vanadium, 0.022% by weight of niobium, 0.496% by weight of tungsten, 0.011% by weight of nitrogen, and iron balance)

The compositions of the high Cr Ferritic/Martensitic steels prepared in the Examples 1 and 2 and Comparative Examples 1 and 2 are summarized in the following Table 1.

TABLE 1

| | Composition (% by weight) | | | | | | | | | | | |
|---|---|---|---|---|---|---|---|---|---|---|---|---|
| Classification | C | Si | Mn | Ni | Cr | Mo | V | Ta | Nb | W | N | B |
| Example 1 | 0.065 | 0.043 | 0.45 | 0.44 | 9.04 | 0.5 | 0.2 | 0.05 | 0.21 | 1.99 | 0.02 | 0.015 |
| Example 2 | 0.069 | 0.042 | 0.452 | 0.450 | 9.1 | 0.51 | 0.107 | 0.05 | 0.21 | 2.0 | 0.02 | 0.015 |
| Comparative Example 1 | 0.096 | 0.060 | 0.44 | 0.19 | 8.95 | 0.48 | 0.204 | — | 0.055 | 1.9 | 0.045 | — |
| Comparative Example 2 | 0.192 | 0.14 | 0.490 | 0.484 | 12.05 | 1.0 | 0.304 | — | 0.022 | 0.496 | 0.011 | — |

Experimental Example

Figure 2:
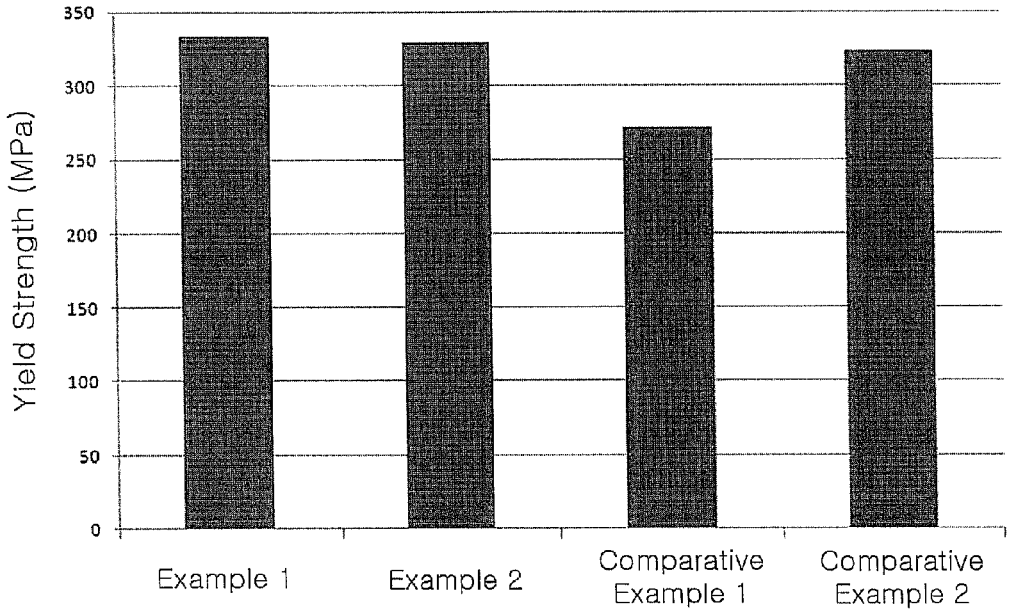
FIG. 2 is a graph illustrating yield strength of high Cr Ferritic/Martensitic steels at 650° C. according to an embodiment of the present invention.

Property Measurement of High Cr Ferritic/Martensitic Steels (1) Measurement of Yield Strength and Tensile Strength To measure the properties of high Cr Ferritic/Martensitic steels prepared in Examples 1 and 2 and Comparative Examples 1 and 2 at a high temperature, tensile test (ASTM E 8M-08) was conducted at 650° C. to measure yield strength and tensile strength, and the results are summarized in Table 2 and FIGS. 1 and 2.

TABLE 2

| Classification | Yield Strength (MPa) | Tensile Strength (MPa) |
|---|---|---|
| Example 1 | 333 | 347 |
| Example 2 | 329 | 342 |
| Comparative Example 1 | 272 | 292 |
| Comparative Example 2 | 323 | 356 |

Figure 3:
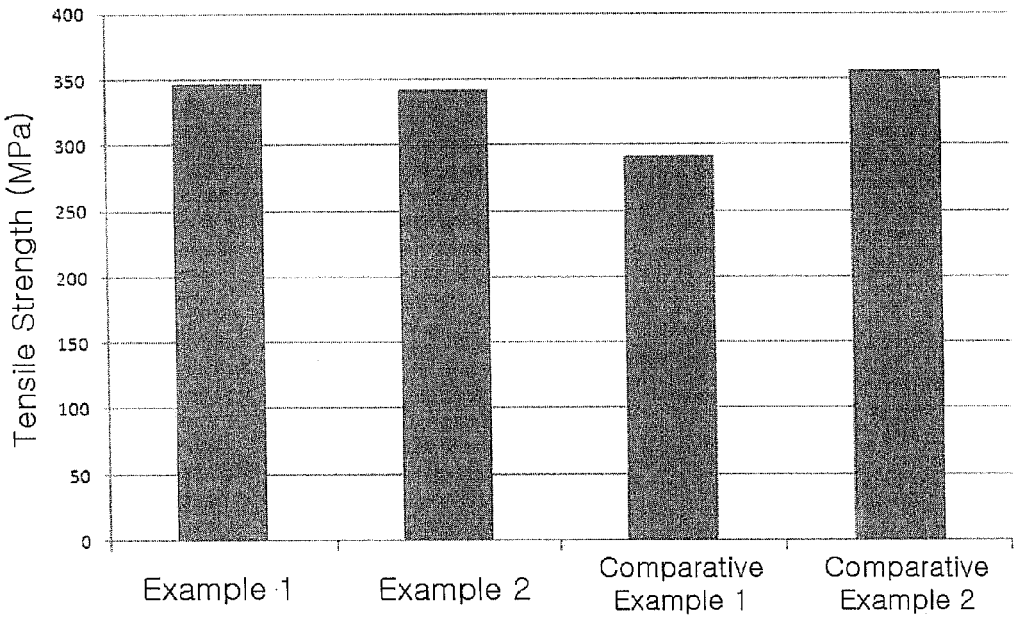
FIG. 3 is a graph illustrating tensile strength of high Cr Ferritic/Martensitic steels at 650° C. according to an embodiment of the present invention.
Figure 4:
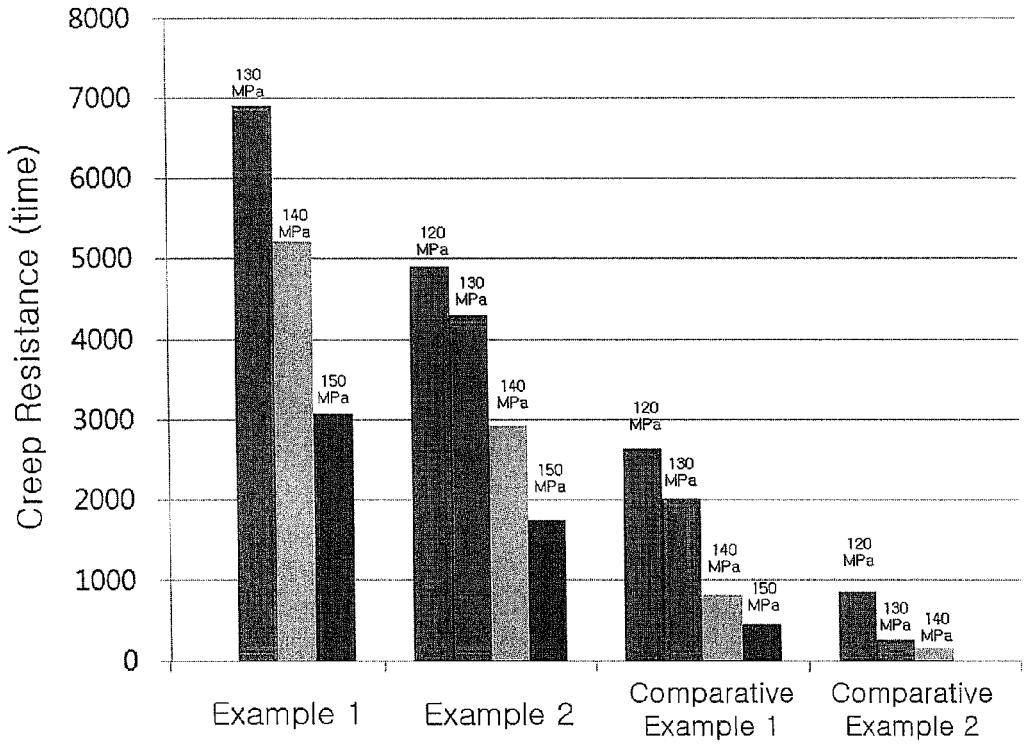
FIG. 4 is a graph illustrating creep resistance of high Cr Ferritic/Martensitic steels at 650° C. according to an embodiment of the present invention.

As shown in Table 2 and FIGS. 2 and 3, the high Cr Ferritic/Martensitic steels according to the present invention have a yield strength of about 330 MPa and a tensile strength of about 340 to 350 MPa. Compared to the conventional high Cr Ferritic/Martensitic steels (Gr. 92 alloy; Comparative Example 1, a yield strength of 272 MPa and a tensile strength of 292 MPa), the high Cr Ferritic/Martensitic steels according to the present invention have superior yield strength and tensile strength.

Therefore, the high Cr Ferritic/Martensitic steels according to the present invention have high yield strength and high tensile strength at a high temperature of 650° C., and may be used as nuclear fuel material for a Generation IV SFR which is used under severe conditions of high temperature and high irradiation of neutrons.

(2) Measurement of Elongation

To measure the properties of high Cr Ferritic/Martensitic steels prepared in Examples 1 and 2, elongation was measured through a tensile test (ASTM E 8M-08) at a temperature of 650° C., and the result is summarized in Table 3.

TABLE 3

| Classification | Elongation (%) |
|---|---|
| Example 1 | 18.8 |
| Example 2 | 18.5 |

As shown in Table 3, the high Cr Ferritic/Martensitic steels prepared according to Examples 1 and 2 of the present invention have an elongation of about 18% or more, and may be used as nuclear fuel material for a Generation IV SFR which is used under severe conditions of high temperature and high irradiation of neutrons.

(3) Measurement of Creep Resistance

To measure the creep resistance of high Cr Ferritic/Martensitic steels prepared according to Examples 1 and 2 and Comparative Examples 1 and 2, rupture times were measured with 150 MPa, 140 MPa, 130 MPa, and 120 MPa stress intensities at a temperature of 650° C., and the result is summarized in Table 4 and FIG. 3.

TABLE 4

| | Creep Resistance (h) | | | |
|---|---|---|---|---|
| Classification | 120 MPa | 130 MPa | 140 MPa | 150 MPa |
| Example 1 | — | 6889 | 5216 | 3071 |
| Example 2 | 4896 | 4290 | 2928 | 1750 |
| Comparative Example 1 | 2641 | 2012 | 814 | 451 |
| Comparative Example 2 | 852 | 261 | 148 | — |

As shown in Table 4 and FIG. 3, the high Cr Ferritic/Martensitic steels according to Examples 1 and 2 of the present invention show much longer rupture time than those in Comparative Examples 1 and 2, and have superior creep resistance compared to conventional high Cr Ferritic/Martensitic steels in Comparative Examples 1 and 2.

Therefore, the high Cr Ferritic/Martensitic steels according to the present invention have improved creep resistance at a high temperature of 650° C., and may be used as nuclear fuel material for a Generation IV SFR which is used under severe conditions of high temperature and high irradiation of neutrons.

The high Cr Ferritic/Martensitic steels according to the present invention have improved tensile strength and creep resistance by optimizing the contents of alloy elements of niobium, tantalum, tungsten, nitrogen, boron, carbon, and the like, and thus may be used as nuclear fuel materials for a generation IV sodium-cooled fast reactor (SFR) which is used under severe conditions of high temperature and high irradiation of neutrons.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A high Cr ferritic and martensitic steel consisting of 0.04 to 0.13% by weight of carbon, 0.03 to 0.07% by weight of silicon, 0.40 to 0.50% by weight of manganese, 0.40 to 0.50% by weight of nickel, 8.5 to 9.5% by weight of chromium, 0.45 to 0.55% by weight of molybdenum, 0.10 to 0.25% by weight of vanadium, 0.02 to 0.05% by weight of tantalum, 0.21 to 0.25% by weight of niobium, 1.5 to 3.0% by weight of tungsten, 0.015 to 0.025% by weight of nitrogen, 0.015% by weight of boron and iron balance.

2. An in-core component in a nuclear reactor, wherein the in-core component comprises the high Cr ferritic and martensitic steel according to claim 1.

3. The in-core component as set forth in claim 2, wherein the nuclear reactor is a sodium-cooled fast reactor (SFR).

4. The in-core component as set forth in claim 2, wherein the in-core component is one selected from the group consisting of a nuclear fuel cladding tube, a duct, and a wire wrap.

5. A high Cr ferritic and martensitic steel according to claim 1, wherein its rupture time measured with 140 MPa at a temperature of 650° C. is 2928 hour or higher than 2928 hour.

6. A high Cr ferritic and martensitic steel according to claim 1, wherein the steel consists of 0.065% by weight of carbon, 0.043% by weight of silicon, 0.45% by weight of manganese, 0.44% by weight of nickel, 9.04% by weight of chromium, 0.5% by weight of molybdenum, 0.2% by weight of vanadium, 0.05% by weight of tantalum, 0.21% by weight of niobium, 1.99% by weight of tungsten, 0.02% by weight of nitrogen, 0.015% by weight of boron, and iron balance.

7. A high Cr ferritic and martensitic steel according to claim 6, wherein its rupture time measured with 140 MPa at a temperature of 650° C. is 5216 hour or higher than 5216 hour.

8. A high Cr ferritic and martensitic steel according to claim 7, wherein its rupture time measured with 140 MPa at a temperature of 650° C. is 5216 hour.

9. A high Cr ferritic and martensitic steel according to claim 1, wherein the steel consists of 0.069% by weight of carbon, 0.042% by weight of silicon, 0.452% by weight of manganese, 0.450% by weight of nickel, 9.1% by weight of chromium, 0.51% by weight of molybdenum, 0.107% by weight of vanadium, 0.05% by weight of tantalum, 0.21% by weight of niobium, 2.0% by weight of tungsten, 0.02% by weight of nitrogen, 0.015% by weight of boron, and iron balance.

10. A high Cr ferritic and martensitic steel according to claim 9, wherein its rupture time measured with 140 MPa at a temperature of 650° C. is 2928 hour or higher than 2928 hour.

* * * * *